United States Patent [19]

Kuromoto

[11] Patent Number: 4,492,148

[45] Date of Patent: Jan. 8, 1985

[54] CONTROL SYSTEM FOR A PLURALITY OF HYDRAULIC ACTUATORS

[75] Inventor: Kazunori Kuromoto, Komatsu, Japan

[73] Assignee: Kabushiki Kaisha Komatsu Seisakusho, Tokyo, Japan

[21] Appl. No.: 451,805

[22] Filed: Dec. 21, 1982

[51] Int. Cl.[3] ..... F15B 11/16

[52] U.S. Cl. ..... 91/523; 91/527; 91/536; 91/445; 91/461

[58] Field of Search ..... 91/527, 445, 521, 530, 91/531, 304, 461, 523, 536; 60/484

[56] References Cited

U.S. PATENT DOCUMENTS

| | | | |
|---|---|---|---|
| 3,854,766 | 12/1974 | Jordan | 294/88 |
| 3,966,066 | 6/1976 | Schexnayder | 91/531 |
| 3,996,840 | 12/1976 | Futamata et al. | 91/461 |
| 4,201,510 | 5/1980 | Muntjanoff | 414/730 |
| 4,244,405 | 1/1981 | Zirker et al. | 91/531 |
| 4,341,149 | 7/1982 | Dezelan | 91/531 |

*Primary Examiner*—Robert E. Garrett
*Assistant Examiner*—Richard S. Meyer
*Attorney, Agent, or Firm*—Armstrong, Nikaido, Marmelstein & Kubovcik

[57] ABSTRACT

A control system for a plurality of hydraulic actuators which requires smaller number of control valves than that of actuators. In one embodiment, three control valves are arranged in parallel for controlling four hydraulic cylinders. The control valves are preferably solenoid-operated and one of control valves are used for supplying a pilot fluid pressure into a plurality of pilot-operated check valves disposed between the control valves and the hydraulic cylinders.

1 Claim, 7 Drawing Figures

CONTROL SYSTEM FOR A PLURALITY OF HYDRAULIC ACTUATORS

BACKGROUND OF THE INVENTION

This invention relates to a control system for a plurality of hydraulic actuators.

There has so far been employed a system for controlling a plurality of hydraulic actuators which comprises control valves for controlling the supply of pressurized fluid into each of the hydraulic actuators, each of the control valves being arranged to be changed over by means of a control lever to supply pressurized fluid into each of the hydraulic actuators.

However, the use of such a control system requires provision of control valves whose number corresponds to that of the hydraulic actuators and also provision of control levers, the number of which is also equal to that of the hydraulic actuators and therefore the operation of the control system becomes very troublesome.

Accordingly, the operation of the hydraulic implements operable by the action of a plurality of cylinders for hydraulic excavators, etc. becomes very troublesome, and therefore such a conventional hydraulic control system is not preferrable from the point of view of both the structure and the operation thereof.

SUMMARY OF THE INVENTION

It is therefore an object of the present invention to provide a control system for a plurality of hydraulic actuators which requires less number of control valves than that of hydraulic actuators to be controlled.

In accordance with an aspect of the present invention, there is provided a control system for a plurality of hydraulic actuators, comprising: a hydraulic pump; first, second, third and fourth hydraulic actuators each having first and second chambers formed therein; first, second, third and fourth conduits each being divided at one end thereof into two auxiliary conduits, each of said auxiliary conduits being connected with either one of said first and second chambers; a plurality of pilot-operated check valves each being disposed in said respective auxiliary conduits for controlling the passage of fluid in a single direction from the hydraulic pump; first solenoid-operated valve means connected at one end thereof with said hydraulic pump and at the other end with said first and second conduits for controlling flow of fluid in said first and second conduits; second solenoid-operated valve means connected at one end thereof with said hydraulic pump and at the other end with said third and fourth conduits for controlling flow of fluid in said third and fourth conduits; first pilot pressure conduit connected with first half of said plurality of check valves; second pilot pressure conduit connected with second half of said plurality of check valves; and third solenoid-operated valve means connected at one end thereof with said hydraulic pump and at the other end with said first and second pilot pressure conduits for selectively supplying fluid pressure into said first and second pilot pressure conduits thereby selectively opening said first half of and said second half of said check valves.

The above and other objects, features and advantages of the present invention will be readily apparent from the following description taken in conjunction with the accompanying drawings.

DESCRIPTION OF THE PREFERRED EMBODIMENT

The present invention will now be described by way of example only with reference to the accompanying drawings. Although in the following description, the control system of the present invention will be explained in connection with a mechanical finger clamp, it should be appreciated that the control system can be applicable to other hydraulically operable devices as well.

Figure 1:
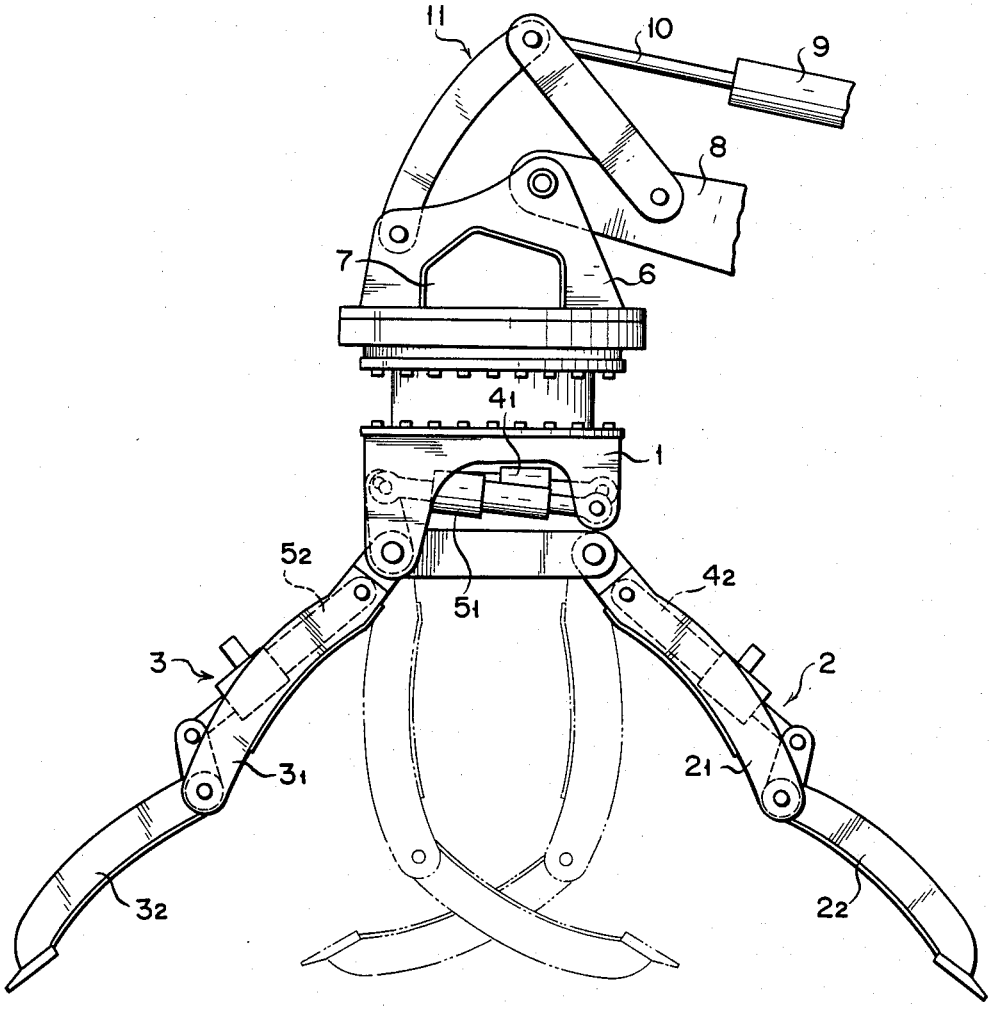
FIG. 1 is a front elevational view of a mechanical finger clamp to be controlled by a hydraulic control system according to the present invention.

FIG. 1 is a front view of a mechanical finger clamp; and

Figure 2:
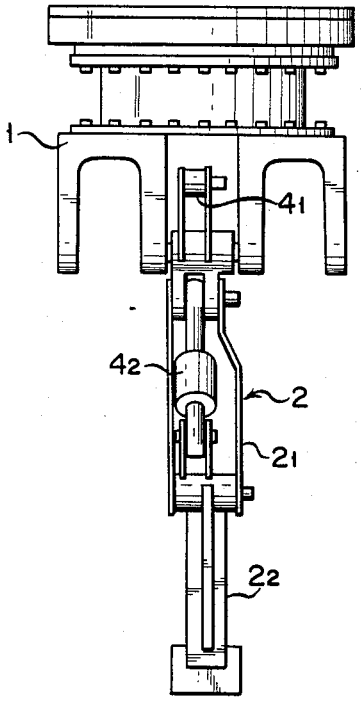
FIG. 2 is a right side elevational view thereof.
Figure 3:
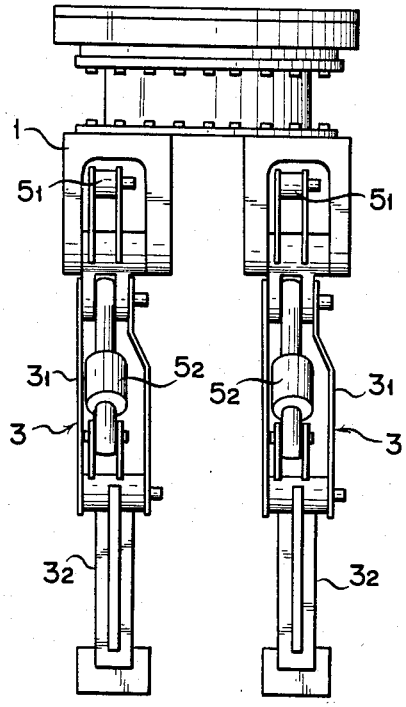
FIG. 3 is a left side elevational view thereof.

FIGS. 2 and 3 are right and left side elevational views, respectively, of the mechanical finger clamp shown in FIG. 1.

The mechanical finger clamp comprises a body 1 provided with a clamp claw 2 on one side thereof and a pair of clamp claws 3, 3 on the other or opposite side thereof, the clamp claws 2, 3, 3 each being arranged to extend and retract its leg freely.

The clamp claws 2, 3, 3 each comprises base end portions $\mathbf{2}_1$, $\mathbf{3}_1$, $\mathbf{3}_1$, respectively, and leading end portions $\mathbf{2}_2$, $\mathbf{3}_2$, $\mathbf{3}_2$ pivotally connected to the base end portions $\mathbf{2}_1$, $\mathbf{3}_1$, $\mathbf{3}_1$, respectively. The base end portions $\mathbf{2}_1$, $\mathbf{3}_1$, $\mathbf{3}_1$ can be swung by the action of first cylinders $\mathbf{4}_1$, $\mathbf{5}_1$, $\mathbf{5}_1$, respectively whilst the leading end portions $\mathbf{2}_2$, $\mathbf{3}_2$, $\mathbf{3}_2$ can be swung by the action of second cylinders $\mathbf{4}_2$, $\mathbf{5}_2$, $\mathbf{5}_2$, respectively.

The body 1 is rotatably mounted on a mount 6 and can be rotated by a turning motor 7. The mount 6 is connected to an arm 8 so as to be pivoted in the vertical direction, the arm 8 being in turn mounted on the vehicle body not shown so that it may be pivoted in the vertical direction.

Connected to the mount 6 through a link 11 is a piston rod 10 of a cylinder 9 which is pivotally connected to the arm 8.

Figure 4:
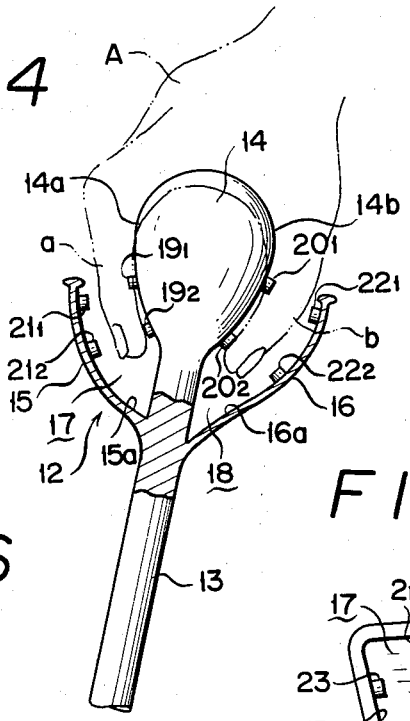
FIG. 4 is a longitudinal sectional view of a control lever for operating the mechanical finger clamp showing various switches mounted on the head end thereof.
Figure 5:
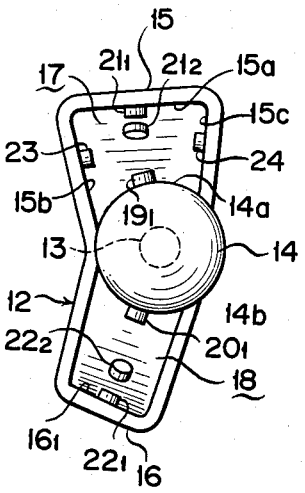
FIG. 5 is a plan view thereof.

FIG. 4 is a longitudinal sectional view of a control lever 12, and FIG. 5 is a plan view of the same. The control lever 12 comprises a rod 13 whose upper part includes a grip portion 14 and first and second members 15 and 16 extending from both sides of it and formed as an integral part thereof thus forming spacings 17 and 18.

The grip portion 14 has first upper and lower switches $\mathbf{19}_1$ and $\mathbf{19}_2$ and second upper and lower switches $\mathbf{20}_1$ and $\mathbf{20}_2$ fitted to its side faces 14*a* and 14*b*, respectively, the switches $\mathbf{19}_2$ and $\mathbf{20}_2$ being longitudinally spaced from the switches $\mathbf{19}_1$ and $\mathbf{20}_1$, respectively. Further, the first and second members 15 and 16 have third upper and lower switches $\mathbf{21}_1$ and $\mathbf{21}_2$ and fourth upper and lower switches $\mathbf{22}_1$ and $\mathbf{22}_2$ fitted to the opposite faces 15*a* and 16*a*, respectively, the switches $21_2$ and $22_2$ being longitudinally spaced from the switches $21_1$ and $22_1$, respectively. Further, fifth and sixth switches 23 and 24 are fitted to the left and right portions 15*b* and 15*c*, respectively, of the first member 15.

Figure 6:
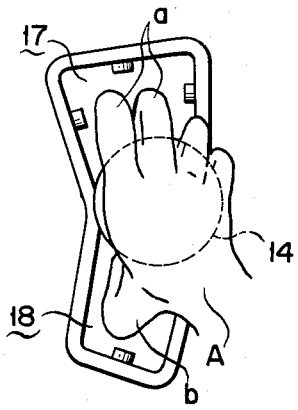
FIG. 6 is a schematic representation showing how the control lever is grasped by fingers.

In operation, the operator holds the grip portion 14 by his hand "A" with two fingers "a" extending into the first space 17 and with thumb "b" into the second space 18 as shown in FIGS. 4 and 6.

Figure 7:
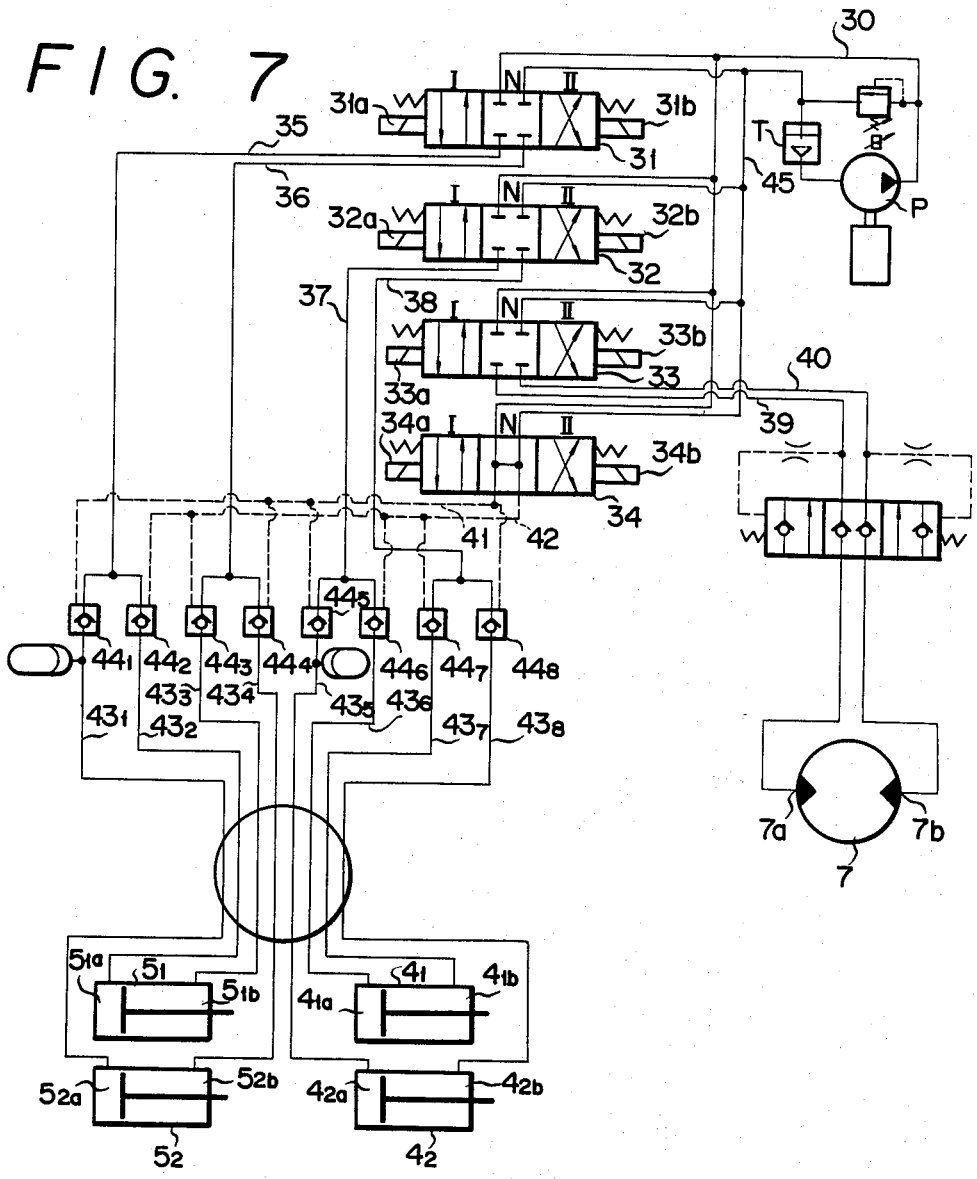
FIG. 7 is a hydraulic circuit of the control system according to the present invention.

FIG. 7 shows a hydraulic circuit employed for the mechanical clamp finger. Connected in parallel with a conduit 30 in which fluid under pressure is supplied by a hydraulic pump 9 are first, second, third and fourth solenoid-operated valves 31, 32, 33 and 34. The first solenoid-operated valve 31 supplies pressurized fluid into first and second conduits 35 and 36, the second solenoid-operated valve 32 supplies pressurized fluid into third and fourth conduits 37 and 38, and the third solenoid-operated valve 33 supplies pressurized fluid into fifth and sixth conduits 39 and 40. The fourth solenoid-operated valve 34 is arranged to supply pilot fluid into first and second pilot pressure conduits 41 and 42. The first conduit 35 is connected through first and second auxiliary conduits $43_1$ and $43_2$ with head end chambers $5_{1a}$ and $5_{2a}$ of first and second cylinders $5_1$ and $5_2$, respectively. In the similar manner, the second conduit 36 is connected through third and fourth auxiliary conduits $43_3$ and $43_4$ with rod end chambers $5_{1b}$ and $5_{2b}$ of the hydraulic cylinders $5_1$ and $5_2$, respectively; the third conduits 37 is connected through fifth and sixth auxiliary conduits $43_5$ and $43_6$ with head end chambers $4_{2a}$ and $4_{1a}$ of the cylinders $4_2$ and $4_1$, respectively; and the fourth conduits 38 is connected through seventh and eighth auxiliary conduits $43_7$ and $43_8$ with rod end chambers $4_{1b}$ and $4_{2b}$ of the hydraulic cylinders $4_1$ and $4_2$, respectively. Further, the fifth and sixth conduits 39 and 40 are connected with a port 7*a* for forward rotation and a port 7*b* for reverse rotation of the motor 7.

The auxiliary conduits $43_1$ to $43_8$ are each provided with first to eighth pilot-operated check valves $44_1$ to $44_8$, respectively. The pilot-operated check valves $44_1$ to $44_8$ serve to prevent the flow of fluid back into a tank T and are arranged, when a pilot pressure is supplied, to permit the flow of fluid into the tank T.

The pilot pressure is supplied from the first pilot pressure conduit 41 into the first, fourth, fifth and eighth pilot-operated check valves $44_1$, $44_4$, $44_5$ and $44_8$, respectively. Further, the pilot pressure is supplied from the second pilot pressure conduit 42 into the second, third, sixth and seventh pilot-operated check valves $44_2$, $44_3$, $44_6$, $44_7$, respectively.

The operation of the mechanical finger clamp of the present invention will now be described below.

(1) When the control lever 12 is not operated, the solenoid-operated valves 31, 32, 33 and 34 are located at their neutral positions N.

Since the fourth solenoid-operated valve 34 is located at its neutral position N, the conduit 30 in which pressurized fluid is supplied from the hydraulic pump P is connected with a drain conduit 45 so that the hydraulic cylinders 4 and 5 cannot be actuated.

(2) When the operator bends inwards the leading ends of his two fingers "a" and thumb "b" to push on the first lower switch $19_2$ and the second lower switch $20_2$, first solenoids 31*a*, 32*a* and 34*a* of the first, second and fourth solenoid-operated valves 31, 32 and 34, respectively, will be energized to shift the respective valves to their first offset positions I.

As a result, the pressurized fluid delivered by the hydraulic pump P is supplied through the first conduit 35 and the first auxiliary conduit $43_1$ into the head end chambers $5_{2a}$ of the second hydraulic cylinders $5_2$, and in the similar manner the fluid under pressure from the pump P is supplied through the third conduit 37 and the fifth auxiliary conduit $43_5$ into the head end chamber $4_{2a}$ of the second hydraulic cylinder $4_2$. Further, the pressurized fluid is supplied as a pilot pressure through the first pilot pressure conduit 41 into the first, fourth, fifth and eighth pilot-operated check valves $44_1$, $44_4$, $44_5$ and $44_8$, respectively. As a result, the rod end chambers $5_{2b}$ and $4_{2b}$ of the hydraulic cylinders $5_2$ and $4_2$, respectively, are connected through the fourth and eighth auxiliary conduits $43_4$ and $43_8$, the fourth and eighth pilot-operated check valves $44_4$ and $44_8$ and the second and fourth conduits 36 and 38, respectively, with the drain conduit 45.

Consequently, the piston rod of the second hydraulic cylinder $4_2$ on one side and the piston rods of the second hydraulic cylinders $5_2$ on the other side will extend so that the leading end portion $2_2$ of the clamp claws 2 on one side and the leading end portions $3_2$ of the clamp claws 3 on the other side may turn inwardly towards each other.

Then, the pressurized fluid is supplied through the second and sixth auxiliary conduits $43_2$ and $43_6$, into the head end chambers $5_{1a}$ and $4_{1a}$ of the first hydraulic cylinders $5_1$ and the first hydraulic cylinder $4_1$, respectively. Whilst, the third and seven pilot-operated check valves $44_3$ and $44_7$ installed in the third and seventh auxiliary conduits $43_3$ and $43_7$ connected with the rod end chambers $5_{1b}$ and $4_{1b}$, respectively, are not supplied with the pilot pressure and therefore prevent the flow of fluid back into the tank so that the pistons of both the first hydraulic cylinders $5_1$ and the first hydraulic cylinder $4_1$ remain inoperative.

(3) When the operator bends inwards the base portions of his two fingers "a" and thumb "b" to push on the first upper switch $19_1$ and the second upper switch $20_1$, the solenoid-operated valves 31 and 32 will assume their first positions I in the same manner as mentioned hereinbefore, and the fourth solenoid-operated valve 34 will assume its second position II because of its second solenoid 34*b* being energized. Therefore, the pressurized fluid delivered by the hydraulic pump P is supplied as a pilot pressure through the second pilot conduit 42 in the second, third, sixth and seventh pilot-operated check valves $44_2$, $44_3$, $44_6$ and $44_7$, respectively. As a result, as in the afore-mentioned case, the piston rod of the first hydraulic cylinder $4_1$ on one side and the piston rods of the first hydraulic cylinders $5_1$ on the other side will extend so that the base end portion $2_1$ of the clamp claws 2 on one side and the base end portions $3_1$ of the clamp claws 3 on the other side may turn inwardly.

(4) When the operator bends outwards or open the leading end portions of his two fingers shown by "a" and thumb "b" to push on the third lower switch $21_2$ and the fourth lower switch $22_2$, the first and second solenoid-operated valves 31 and 32 will be located at their second offset positions II because of their second solenoids 31*b* and 32*b* being energized, and the fourth solenoid-operated valve 34 will be located at its first offset position I because of its first solenoid 34*a* being energized. Consequently, the pressurized fluid delivered by the hydraulic pump P will be supplied into the second and fourth conduits 36 and 38 and the first pilot pressure conduit 41, respectively.

For this reason, in the similar manner as in the aforementioned case (2), the piston rod of the second hydraulic cylinder $4_2$ on one side and the piston rods of the second hydraulic cylinder $5_2$ on the other side will be retracted so that both the leading end portion $2_2$ of the clamp claw 2 on one side and the leading end portion $3_2$ of the clamp claws 3 on the other side may swing outwardly (or expand).

(5) When the operator bends or open the base portions of his two fingers shown by "a" and thumb "b" to push on the third upper switch $21_1$ and the fourth upper switch $22_1$, the first, second and fourth solenoid-operated valves 31, 32 and 34 will be located at the respective second offset positions II. As a result, in the similar manner as in the aforementioned case (3), the piston rod of the first hydraulic cylinder $4_1$ on one side and the piston rods of the first hydraulic cylinders $5_1$ on the other side will be retracted so that the base end portion $2_1$ of the clamp claw 2 on one side and the base end portions $3_1$ of the clamp claws 3 on the other side may swing outwardly or open.

(6) When the operator moves his fingers "a" to the left to render the fifth switch 23 on, the third solenoid-operated valve 33 will be located at its first offset position I because of its first solenoid 33*a* being energized so that the fluid under pressure delivered by the hydraulic pump P may be supplied through the fifth conduit 39 into the port 7*a* for forward rotation of the motor 7 thereby rotating the body 1 counter-clockwise.

(7) When the operator moves his fingers "a" to the right to press the sixth switch 24 on, the third solenoid-operated valve 33 will be located at its second offset position II because of its second solenoid 33*b* being energized, the pressurized fluid delivered by the hydraulic pump P will be supplied through the sixth conduit 40 into the reversing port 7*b* of the motor 7 to reversely drive the latter thus rotate the body 1 in the clockwise direction.

Thus, the clamp claws 2 and 3 can be actuated in the same direction as those of operation of the fingers "a" and "b", and therefore the mechanical finger clamp can be operated in a simple manner only by one hand of the operator.

Further, if all the switches are of touch key type which can turn its electric circuit on and off by applying a slight pressure given by the operator's fingers, then the fatigue of the operator can be remarkably relieved even though he operates the clamp for an extended period of time.

It is to be understood that the foregoing description is merely illustrative of a preferred embodiment of the invention and that the scope of the invention is not to be limited thereto, but is to be determined by the scope of the appended claims.

What is claimed is:

1. A control system for a plurality of hydraulic actuators, comprising:

a hydraulic pump;

first, second, third and fourth hydraulic actuators each having first and second chambers formed therein;

first, second, third and fourth conduits each being divided at one end thereof into two auxiliary conduits, each of said auxiliary conduits being connected with either one of said first and second chambers of different actuators;

a plurality of pilot-operated check valves each being disposed in said respective auxiliary conduits for controlling the passage of fluid in a single direction from said hydraulic pump;

first solenoid-operated valve means connected at one end thereof with said hydraulic pump and at the other end with said first and second conduits for controlling flow of fluid in said first and second conduits; second solenoid-operated valve means connected at one end thereof with said hydraulic pump and at the other end with said third and fourth conduits for controlling flow of fluid in said third and fourth conduits;

first pilot pressure conduit connected with the first half of said plurality of check valves;

second pilot pressure conduit connected with the second half of said plurality of check valves; and third solenoid-operated valve means connected at one end thereof with said hydraulic pump and at the other end with said first and second pilot pressure conduits for selectively supplying fluid pressure into said first and second pilot pressure conduits thereby selectively opening said first half of and said second half of said check valves;

said first solenoid-operated valve means having a neutral position at which said first valve is closed, a first offset position at which said first conduit is connected with said hydraulic pump and said second conduit is connected with a tank and a second offset position at which said first conduit is connected with the tank and said second conduit is connected with said hydraulic pump;

said second solenoid-operated valve means having a neutral position at which said second valve is closed, a first offset position at which said third conduit is connected with said hydraulic pump and said fourth conduit is connected with the tank and a second offset position at which said third conduit is connected with the tank and said fourth conduit is connected with said hydraulic pump;

said third solenoid-operated valve means having a neutral position at which said first and second pilot pressure conduits are connected with the tank, a first offset position at which said first pilot pressure conduit is connected with said hydraulic pump and said second pilot pressure conduit is connected with the tank and a second offset position at which said first pilot pressure conduit is connected with the tank and said second pilot pressure conduit is connected with said hydraulic pump.

* * * * *